US006603386B2

(12) United States Patent
Sood et al.

(10) Patent No.: US 6,603,386 B2
(45) Date of Patent: Aug. 5, 2003

(54) BI-STABLE MICROSWITCH INCLUDING SHAPE MEMORY ALLOY LATCH

(75) Inventors: Dinesh Kumar Sood, Ringwood (AU); Ronald Barry Zmood, North Caulfield (AU)

(73) Assignee: Alcatel, Paris (FR)

( * ) Notice: Subject to any disclaimer, the term of this patent is extended or adjusted under 35 U.S.C. 154(b) by 36 days.

(21) Appl. No.: 09/885,168

(22) Filed: Jun. 21, 2001

(65) Prior Publication Data

US 2002/0036562 A1 Mar. 28, 2002

(30) Foreign Application Priority Data

Jun. 22, 2000 (AU) ..... PQ8311

(51) Int. Cl.[7] ..... H01H 37/00; H01H 37/32

(52) U.S. Cl. ..... 337/411; 337/131; 337/141; 337/140

(58) Field of Search ..... 337/123, 140, 337/141, 105, 411, 131

(56) References Cited

U.S. PATENT DOCUMENTS 3,968,380 A * 7/1976 Jost et al. ..... 307/99
4,434,413 A * 2/1984 Pelletier et al. ..... 337/71
4,616,206 A 10/1986 Bridges et al.
4,713,643 A 12/1987 Baum et al.
4,841,730 A 6/1989 McDonald
5,619,177 A * 4/1997 Johnson et al. ..... 337/140
5,702,012 A 12/1997 Kanjo

FOREIGN PATENT DOCUMENTS

EP 0 866 484 A2 9/1998

OTHER PUBLICATIONS

Derwent Abstract Accession No. 87–047082/07, J6 2005524 A (Mitsubishi Denki KK) Jan. 12., 1987. Whole document.

Derwent Abstract Accession No. 83 844095/50, SU 1001221 A (Low Voltage Equipment) Feb. 28, 1983. Whole document.

* cited by examiner

*Primary Examiner*—Jayprakash N. Gandhi
(74) *Attorney, Agent, or Firm*—Sughrue Mion, PLLC

(57) ABSTRACT

A bi-stable microswitch (1) including a pair of contacts (6, 7) and an armature (4) movable between a first position and a second position to selectively make or break the pair of contacts, the armature being latched in the second position by a shape memory alloy latch (14), wherein the shape memory alloy latch is caused to deform upon heating so as to permit the armature to return to the first position.

16 Claims, 4 Drawing Sheets

BI-STABLE MICROSWITCH INCLUDING SHAPE MEMORY ALLOY LATCH

BACKGROUND OF THE INVENTION

The present invention relates generally to microswitch arrays and microswitch array elements for switching electrical signal lines. The invention is applicable to the switching of telecommunications signal lines and it will be convenient to hereinafter describe the invention in relation to that exemplary, non limiting application.

Switching arrays are used in telecommunication applications, when a large number of telecommunication signal lines are required to be switched. Generally, such switching arrays are provided by the permanent connection of copper pairs to "posts" or underground boxes, requiring a technician to travel to the site of the box to change a connection.

In order to remotely alter the copper pair connections at the box without the need for a technician to travel to the site, there have been proposed switching arrays consisting of individual electro mechanical relays wired to printed circuit boards. However, this type of array is complex, requires the addition of various control modules and occupies a considerable amount of space. Further, current must be continuously provided through the relay coil in order to maintain the state of the relay. Since in many applications switching arrays elements are only rarely required to be switched, this results in an undesired power consumption.

It would therefore be desirable to provide a switching array and switching array element which ameliorates or overcomes one or more of the problems of known switching arrays.

It would also be desirable to provide a bi-stable broad band electrically transparent switching array and switching array element adapted to meet the needs of modem telecommunications signal switching.

It would also be desirable to provide a switching array and switching array element that facilitates the remotely controllable, low power bi-stable switching of telecommunication signal lines.

SUMMARY OF THE INVENTION

With this in mind, one aspect of the present invention provides a bi-stable microswitch including a pair of contacts and an armature movable between a first position and a second position to selectively make or break the pair of contacts, the armature being latched in the second position by a shape memory alloy latch, wherein the shape memory alloy latch is caused to deform upon heating so as to permit the armature to return to the first position.

In one embodiment, the armature includes a shape memory alloy element causing movement of the armature from the first position to the second position upon heating of the armature.

The armature may be resiliently biased towards the first position when latched so that upon removal of the heat and the deformation of the shape memory alloy latch, the armature returns to the first position.

The bi-stable microswitch may further include a first heating device formed on or proximate the shape memory alloy latch. A second heating device may also be formed on or proximate the armature. One or more of the first and second heating devices may include an electrical resistance element.

Alternatively, heat may be applied to at least one of the armature and the shape memory alloy latch by means of electromagnetic radiation. For example, laser, microwave or other radiation may be applied by non-contact means from a remote location.

Another aspect of the invention provides an array of bi-stable microswitches as described above. Each of the microswitches may be at least partly formed in a common substrate by micromachining techniques.

BRIEF DESCRIPTION OF THE DRAWINGS

The following description refers in more detail to the various features of the switching array and switching array element of the present invention. To facilitate an understanding of the invention, reference is made in the description to the accompanying drawings where the invention is illustrated in a preferred but non limiting embodiment.

In the drawings.

DETAILED DESCRIPTION OF THE INVENTION

Figure 1:
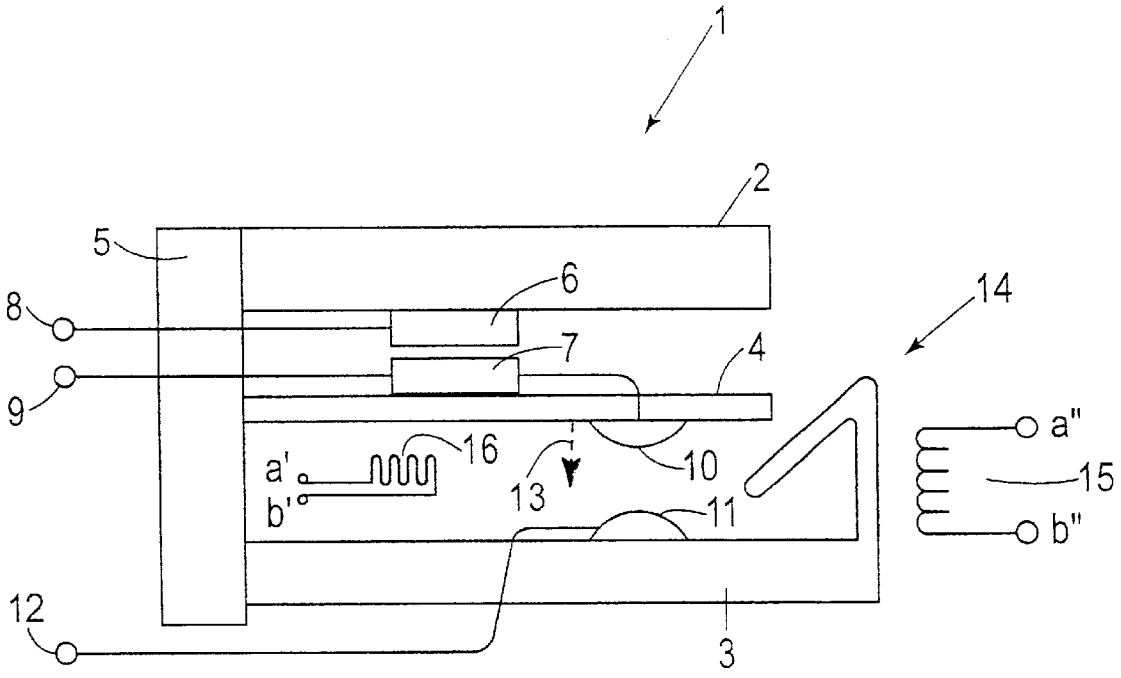
FIG. 1 is a schematic diagram illustrating an embodiment of a bi-stable microswitch according to the present invention.

Referring now to FIG. 1, there is shown generally a first embodiment of a microswitch 1 formed in an electrically inert substrate, such as glass or silicon.

The microswitch 1 comprises two non-conductive arms 2 and 3, formed of silicon or like material, and an armature 4. The arms 2 and 3 and the armature 4 project from a base member 5. Metal contacts 6 and 7 are formed on facing surfaces of the arm 2 and the armature 4 so that in the stable state shown in FIG. 1, the contacts 6 and 7 touch. The contact 6 is connected to a terminal 8 and the contact 7 is connected to a terminal 9. Accordingly, the touching of the contacts 6 and 7 establishes a short circuit between the terminals 8 and 9.

Similarly, a pair of contacts 10 and 11 are formed on facing surfaces of the armature 4 and the arm 3. The electrical contact 11 is connected to a terminal 12. Touching of the contacts 10 and 11 establishes a short circuit between the terminals 9 and 12.

In this embodiment, the shape memory element of the armature 4 has a lower transition temperature $T_1$ above which the armature is caused to move from the stable position shown in FIG. 1 in the direction indicated by the arrow 13, so as to cause the metal contacts 10 and 11 to touch. This is referred to as the second position. Armature is held in this position by a shape memory alloy latch 14 which acts like a spring pressing down on the armature 4 from above.

When the temperature of the shape memory alloy element falls to below the lower transition temperature $T_1$, the armature 4 is resiliently bent towards the position indicated in FIG. 1 but held in the second position by the downwards spring action of latch 14.

The arm 3 of the bi-stable microswitch 1 includes a shape memory alloy latch 14 having an upper transition temperature $T_2$ where $T_2$ is greater than $T_1$. When the temperature of the shape memory alloy latch 14 is below the upper transition temperature $T_2$, the shape memory alloy latch 14 remains in the hook-like shape shown in FIG. 1. However, when the temperature of the shape memory alloy latch 14 exceeds the upper transition temperature $T_2$, the latch 14 is caused to deform upwards so as to permit the armature 4 to return to the stable position shown in FIG. 1.

Electrical contacts a" and b" are formed on the surface of the shape memory alloy latch 14 and an electrical resistance element 15, such as an NiCr heating coil, is applied to the surface of the shape memory alloy latch 14 by vapour deposition or like technique.

Contacts a' and b' are then formed on the lower surface of the armature 4. A heating coil 16 is formed by vapour deposition on the armature.

Figure 2:
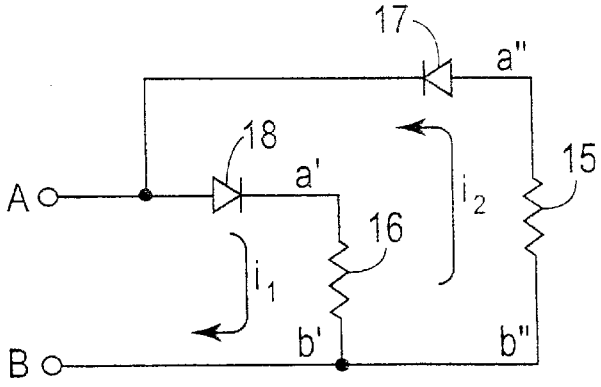
FIG. 2 is a circuit diagram showing the interconnection of two heating elements forming part of the bi-stable microswitch of FIG. 1.

The heating coils 15 and 16 may be connected in parallel as shown in FIG. 2. In this arrangement, diodes 17 and 18 are respectively connected in series with the heating coils 15 and 16 in order that the application of a potential difference between common terminals A and B induces the flow of electrical current in only one heating coil at a time.

The operation of the bi-stable microswitch 1 will now be explained. Initially the microswitch 1 is in the stable state shown in FIG. 1. The microswitch will remain in this state indefinitely until a positive potential difference is applied across the terminals A and B. This causes a current flow $i_1$ through the heating coil 16, causing the temperature in the shape memory alloy element in the armature 4 to rise above the lower transition temperature $T_1$.

The armature 4 is accordingly caused to deform in the direction of the arrow 13 so as to cause the electrical contacts 10 and 11 to touch. In so doing, the shape memory alloy latch 14 is momentarily deflected by the armature 4, and, once the armature 4 has moved past, latches the armature 4 in place by engagement of the shape memory alloy latch 14 on the upper surface of the armature 4.

To release the armature, a negative potential difference is applied between the terminals A and B, thus causing the flow of a current $i_2$ through the heating coil 15. This heats the shape memory allow latch 14. When the temperature of the latch 14 exceeds the upper transitions temperature $T_2$, the shape memory alloy latch 14 is caused to deform upwards so as to permit the armature 4 to return to the stable position shown in FIG. 1. Since negligible current is flowing through the heating coil 16 at this time, the armature 4 is no longer caused to deform in the direction of the arrow 13. The armature 4 then returns to the stable position shown in FIG. 1 due to its resilient biasing towards this position.

It will be noted that the bi-stable switch 1 has two stable states with the pair of contacts 10 and 11 being indefinitely open in a first state (shown in FIG. 1) and indefinitely closed in a second state. Similarly, the pair of contacts 6 and 7 is indefinitely closed in that first state and indefinitely opened in the second state. It does not require the supply of electrical power in either of these two stable states. Electrical power only needs to be provided for a short period, typically a few milliseconds, to cause a transition from one state to the other.

Although the embodiment illustrated in FIGS. 1 and 2 relies upon the use of heating devices formed on or proximate the armature 4 and shape memory alloy latch 14, in alternative embodiments heat may be applied to at least one of these elements by means of electromagnetic radiation. For example, laser, microwave or other radiation may be applied by non contact means from a remote location.

A microswitch of the type illustrated in FIGS. 1 and 2 can easily be fabricated to have a "foot print" of less than 1 milimeter×5 millimeters, and is amenable to fabrication using batch processing, standard photolithography, electroforming and other micromachining processes.

Figure 3:
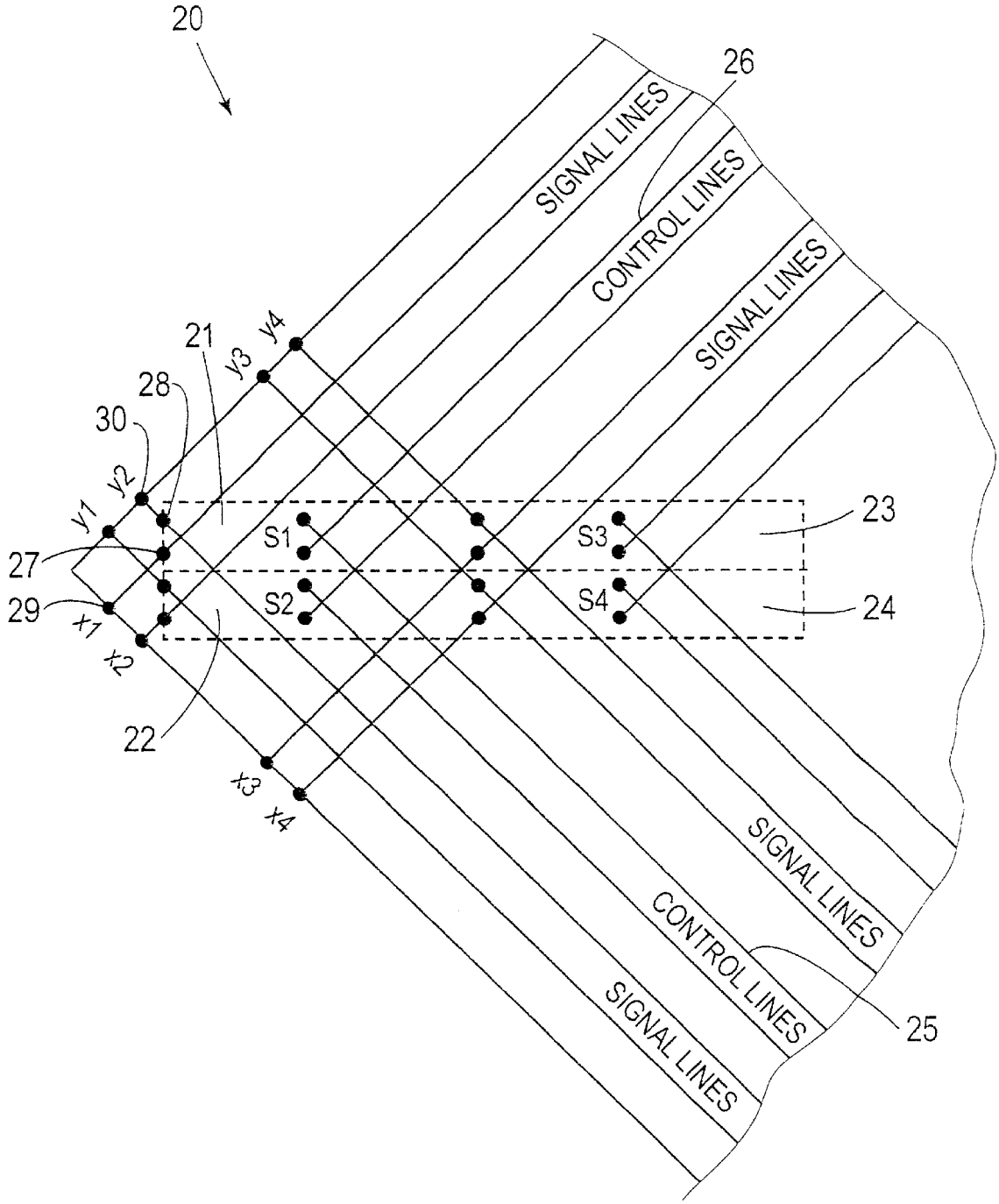
FIG. 3 is one embodiment of a switching array including bi-stable microswitches of the type shown in FIG. 1.

Moreover, such micro machining techniques facilitate the fabrication of a microswitch array of elements such as the microswitch illustrated in FIGS. 1 and 2. FIG. 3 illustrates one example of a microswitch array 20 including bi-stable microswitch elements 21 to 24 each identical to the microswitch 1 shown in FIG. 1. In the example illustrated, control lines 25 and 26 are respectively connected to terminals A and B of the bi-stable microswitch element. Application of a potential difference between the control lines 25 and 26 in the manner described in relation to FIG. 2 causes the selective short circuiting of the pair of contacts 27 and 28, thus interconnecting signal lines 29 and 30. Other microswitch elements within the array 20 operate in a functionally equivalent manner.

Figure 4:
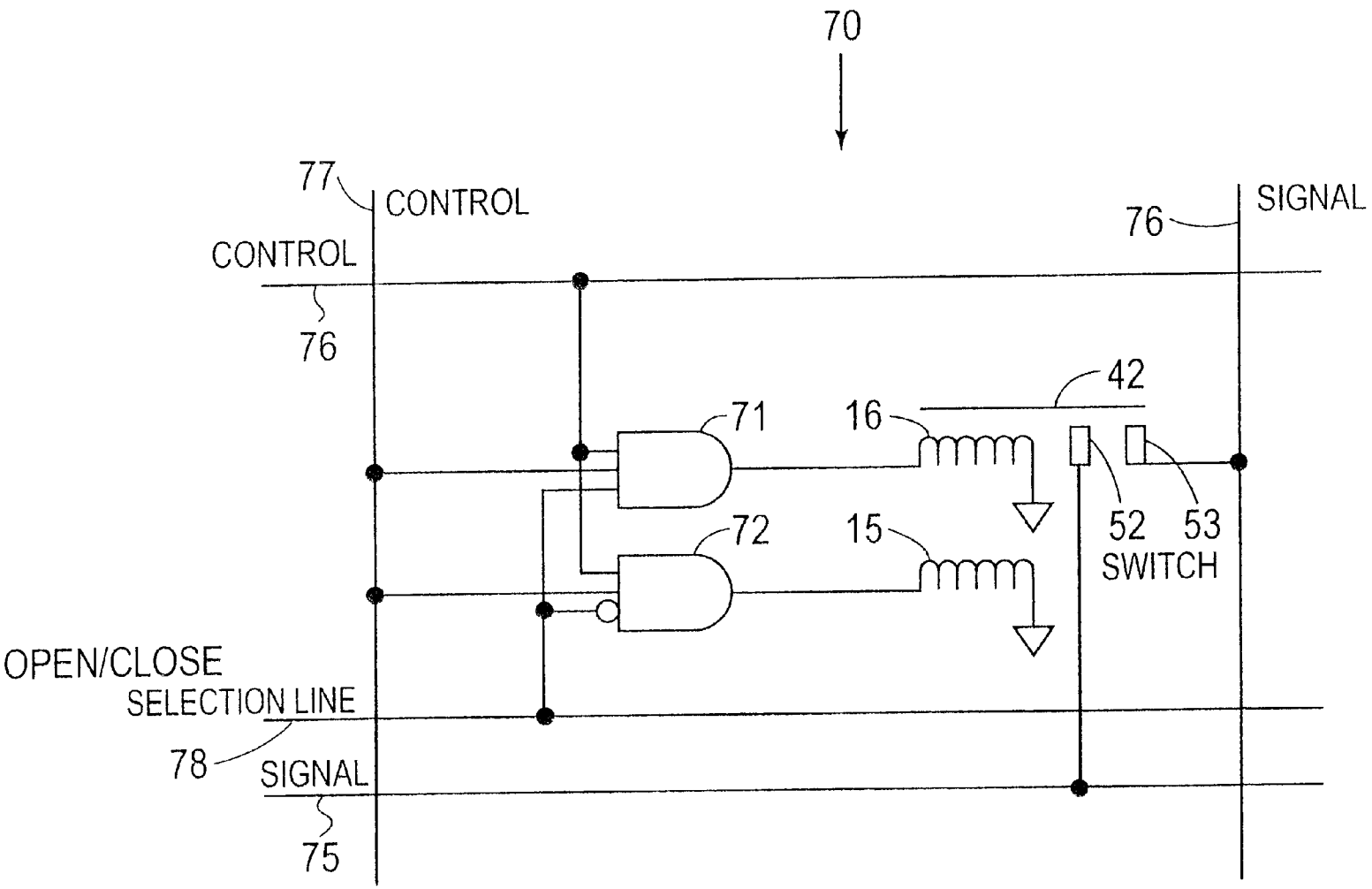
FIG. 4 is a circuit diagram showing a second embodiment of a control circuit for the control of two heating elements forming part of the bi-stable microswitch of FIG. 1.

FIG. 4 shows a control circuit 70 for enabling selective operation of the microswitch 1. This control circuit, which can be implemented using TTL logic directly fabricated into the silicon substrate 41, includes two AND gates 71 and 72. The output of the AND gate 71 is connected to a heating coil 73 deposited on the actuator 42, whereas the output of the AND gate 72 is connected to a heating coil 74. The electrical contacts provided by the metallic columns 52 and 53 of the microswitch 40 are respectively connected to signal lines 75 and 76. The AND gate 71 includes three inputs, respectively connected to the control lines 76 and 77, and a bimorph/thermalloy selection line 78. The AND gate 72 includes three inputs, respectively connected to the control lines 76 and 77, and also an inverting input connected to the open/close selection line 78.

The microswitch 70 remains in a bi-stable state controlled by the logical high or low signal of the open/close selection line 78. Accordingly, upon the placement of a logically high signal on the control lines 76 and 77, and the placement of a logically high signal on the open/close selection line 78, a logically high output is placed at the output of the AND gate 71, causing current to flow through the heating coil 73 and the consequent operation of the actuator 42. Accordingly, the actuator 42 is brought into contact with the two metallic contacts 52 and 53 to thereby interconnect signal lines 75 and 76.

Upon the placement of a logically low signal on the open/close selection line 78, the output of the AND gate 72 goes high, and a current is caused to flow through the heating coil 74 causing actuator 42 to return to its at rest position in which contact is broken with the metallic contacts 52 and 53 and the signal line 75 and 76 are disconnected.

Figure 5:
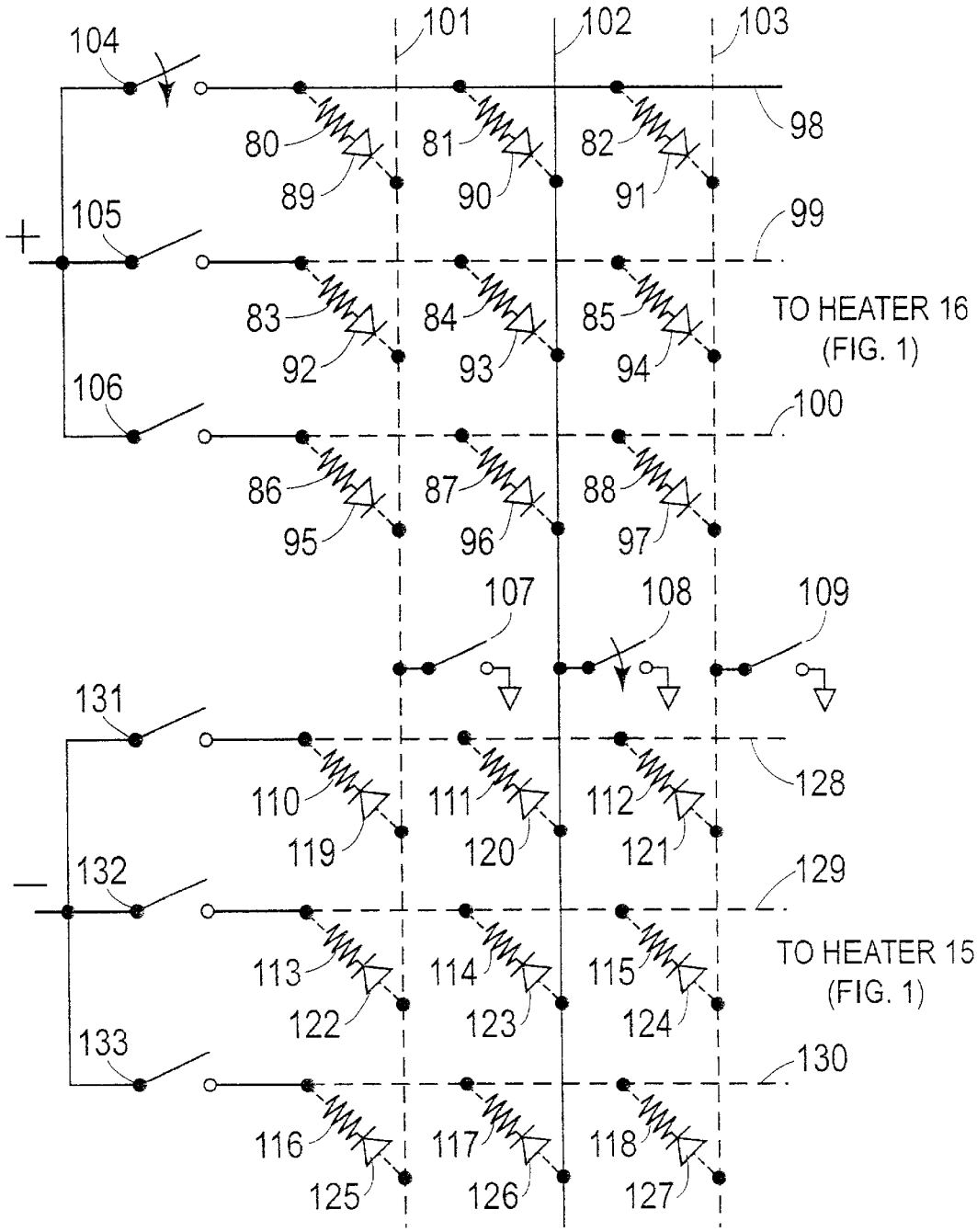
FIG. 5 is a circuit diagram showing an embodiment of an array of control circuits for control of heating elements forming part of an array of bi-stable microswitches according to the present invention.

FIG. 5 shows an implementation of the control circuit using steering diodes as shown in FIG. 2. In this arrangement, an array of heating coils 80 to 88 and associated steering diodes 89 to 97 are provided, each heating coil/diode pair acting to heat the actuator of a separate microswitch. Rows of adjacent heating coils/diode pairs are interconnected by control lines 98 to 100, whilst columns of adjacent heating coils/diode pairs are interconnected by control lines 101 to 103. Selective operation of control switches 104 to 106 in the control lines 98 to 100, and control switches 107 to 109 in the control lines 101 to 103, selectively interconnect a positive power source to ground through one of the heating coils, thus causing activation of that selected actuator.

Similarly, further heating coils 110 to 118 and associated steering diodes 119 to 127 act to heat the "release" actuators of individual microswitches in the array. Control lines 128 to 130 interconnect rows of adjacent heating coils/diode pairs, whilst columns of adjacent heating coil/diode pairs are interconnected by the control lines 101 to 103. Control switches 131 to 133 selectively connect control lines 128 to 130 to a negative power supply. Selective operation of the control switches 131 to 133 and control switches 107 to 109 cause current to flow through a selected heating coil/diode pair, and the heating of the "release" actuators of a selected microswitch.

Finally, it is to be understood that various modifications and/or additions may be made to the microswitch array and microswitch element without departing from the ambit of the present invention described herein.

What is claimed is:

1. A bi-stable micro switch including:

a pair of contacts; and an armature movable between a first position and a second position to selectively make or break the pair of contacts, the armature being latched in the second position by a shape memory alloy latch heated by a heating means proximate to the armature, wherein the shape memory alloy latch is caused to deform upon heating, so as to permit the armature to return to the first position.

2. The bi-stable microswitch according to claim 1, wherein the armature includes a shape memory alloy element causing movement of the armature from the first position to the second position upon heating of the armature.

3. The bi-stable microswitch according to claim 2, wherein the armature is resiliently biased towards the first position when latched so that upon removal of the heat and the deformation of the shape memory alloy latch, the armature returns to the first position.

4. The bi-stable microswitch according to claim 3, wherein one or more of a first heating device formed on or proximate to the shape memory alloy latch and said heating means comprising a second heating device formed on or proximate to the armature includes an electrical resistance element.

5. The bi-stable microswitch according to claim 4, wherein laser, microwave or other radiation is applied by non-contact means from a remote location.

6. An array of bi-stable microswitches according to claim 5, wherein each of the microswitches is at least partly formed in a common substrate by micromachining techniques.

7. The micro switch of claim 4, wherein said first heating device and said second heating device are coupled in parallel, so that application of a potential difference between common terminals of said first heating device and said second heating device induces flow of electrical current in only one of said first heating device and said second heating device at a time.

8. The bi-stable microswitch according to claim 1, further including a first heating device formed on or proximate to the shape memory alloy latch.

9. The bi-stable microswitch according to claim 1, said heating means including a second heating device formed on or proximate to the armature.

10. The bi-stable microswitch according to claim 1, wherein heat is applied to at least one of the armature and the shape memory alloy latch by means of electromagnetic radiation.

11. An array of bi-stable microswitches, each micro switch having features according to claim 1.

12. The micro switch of claim 1, wherein said heating means heats a shape memory element of said armature above a lower transition temperature to move said armature to said second position and cause a first metal contact and a second metal contact to touch.

13. The micro switch of claim 1, wherein said armature returns to said second position when said shape memory alloy latch is heated to an upper transition temperature to deform said shape memory alloy latch to upwards in order to cause said armature to move to said first position.

14. The microswitch of claim 1, wherein said heating means comprises a first contact and a second contact formed on a lower surface of said armature.

15. The microswitch of claim 14, wherein application of a positive potential differential across said first contact and said second contact results in a heating of said heating means.

16. The microswitch of claim 1, wherein said microswitch has a footprint of less than 1 mm×5 mm.

* * * * *